US006199729B1

(12) United States Patent
Drzymkowski

(10) Patent No.: US 6,199,729 B1
(45) Date of Patent: Mar. 13, 2001

(54) HANDS-FREE DRINKING SYSTEM

(76) Inventor: Mark Stephen Drzymkowski, 24821 Bent Tree La., Lake Forest, CA (US) 92630-2402

( * ) Notice: Subject to any disclaimer, the term of this patent is extended or adjusted under 35 U.S.C. 154(b) by 0 days.

(21) Appl. No.: 08/982,273

(22) Filed: Dec. 1, 1997

(51) Int. Cl.[7] ..... A45F 3/20; B67D 5/64

(52) U.S. Cl. ..... 224/148.2; 224/647; 222/175; 251/342; 138/120; 220/705; 239/33

(58) Field of Search ..... 224/148.2, 647, 224/650, 651, 652, 627; 239/33; 215/588; 220/705; 251/342; 222/175; 138/120

(56) References Cited

U.S. PATENT DOCUMENTS

| | | | |
|---|---|---|---|
| 4,090,650 | 5/1978 | Gotta . | |
| 4,139,130 | 2/1979 | Glusker et al. | 224/148.2 |
| 4,852,781 | 8/1989 | Snurnick et al. . | |
| 4,921,143 | 5/1990 | Billet | 222/175 |
| 4,948,023 | 8/1990 | Tripp | 224/148.2 |
| 5,060,833 | 10/1991 | Edison et al. . | |
| 5,263,618 | 11/1993 | Talavera . | |
| 5,282,557 | 2/1994 | McCook | 224/148.2 |
| 5,400,934 | 3/1995 | Ducors . | |
| 5,427,290 | 6/1995 | Thatcher . | |
| 5,449,206 | 9/1995 | Lockcwood | 138/120 |
| 5,601,207 | 2/1997 | Paczonay . | |

*Primary Examiner*—Linda J. Sholl
(74) *Attorney, Agent, or Firm*—Gene Scott; Patent Law & Venture Group

(57) ABSTRACT

A portable drinking facilitation apparatus is useful for a bicyclist and provides a liquid reservoir and a reservoir delivery tube. The apparatus has a flexible drinking tube having a mounting end and a terminal end. The drinking tube is adapted for shaping, such that said ends are positioned as desired, and the drinking tube will hold the given shape until said ends are repositioned. In its preferred mode, the flexible drinking tube comprises a plurality of tube segments joined end-to-end to form an extended elongate tube. A bite valve is removably mounted at the terminal end of the drinking tube. The apparatus also has a base fitting for receiving the mounting end of the drinking tube. The base fitting is adapted for receiving an end of the reservoir delivery tube and the mounting end of the drinking tube. This arrangement allows water to flow from the reservoir delivery tube, through the base fitting, and into the drinking tube, from which it is dispensed to the user. This base fitting is attached to a flexible base plate having a pair of attachments to hold the flexible base plate to a bicyclist's chest strap and place the bite valve within reach of the lips of the bicyclist.

9 Claims, 2 Drawing Sheets

HANDS-FREE DRINKING SYSTEM

BACKGROUND OF THE INVENTION

1. Field of the Invention

This invention relates generally to a portable drinking apparatus, and more particularly to a drinking tube having a bite valve which can be easily and securely attached to a person's chest and manipulated to dispense water to the person without significant effort on the part of the person.

2. Description of Related Art

The following art defines the present state of this field:

Gotta, U.S. Pat. No. 4,090,650 describes a canteen provided with a drinking straw extending through the top of the screw cap of the canteen. The straw may be pushed substantially completely into the canteen when the straw is not used or it may be withdrawn from the canteen to a substantial length such that one may drink from the canteen without removing it, for example, from a belt. The screw cap and canteen neck are provided with cooperating elements which pinch the straw closed in the closed position of the cap.

Shumick/Bradley, U.S. Pat. No. 4,852,781 describes a runner's portable water supply. The supply comprises of a water bottle with a special cap and sipping tube. The sipping tube is curved and only slightly flexible so that it can be bent, but retains its shape if the wearer does not bend it. The cap fits into the bottle neck in a liquid tight coupling and has a first interior surface slideably mating with the tube in a substantially liquid tight coupling and has a second interior tunnel permitting gas to enter the bottle but deflecting liquid so that liquid cannot splash out of the bottle. The bottle is coupled to a selected part of the wearer's body with the upper end of the tube near the wearer's mouth and the lower end of the tube near the bottom interior surface of the bottle. Air flows into the bottle as liquid is sipped out. The bottle need not be held.

Tripp, U.S. Pat. No. 4,948,023 describes a fluid storing and supply device including two fluid containers supported within outer pouches and a conduit extending from each fluid container through which liquid contained in the containers can be consumed. A harnessing arrangement for harnessing the device to the body of a person which includes straps of predetermined length whereby the pouches can be suspended on a person's rib cage with one pouch abutting the person's chest and the other pouch abutting the person's back. Further straps permit tying of the positioned pouches to the rib cage in a manner that the pouches bear upon the rib cage so that a substantial part of the pressure exerted by the weight of fluid stored in the fluid containers is distributed over the surface area of the rib cage borne upon by the pouches and the harnessing arrangement.

Edison/Henderson, U.S. Pat. No. 5,060,833 describes a water system that allows a bicyclist to drink liquids anytime he desires. The system has a collapsible container of water or other liquid stored within a flexible back pack that is removably secured at a location between the shoulders of the bicyclist. A resilient mouthpiece adapted to be held in the mouth of the bicyclist is connected to the container by a length of tubing. The mouthpiece is a valve device and has a cylindrical sidewall that forms a chamber. A spring biased valve element located inside the chamber normally prevents flow therethrough. When the opposed sidewalls of the chamber are compressed between the teeth, liquid flows through the mouthpiece. This allows the mouthpiece to be held securely between the lips and whenever the sidewalls are compressed by the teeth, fluid flows from the container, through the tubing and into the mouth of the bicyclist.

Talavera, U.S. Pat. No. 5,263,618 describes a universal carrier which comprises of a pocket holding support and a harness for attachment to the body of a person carrying object on the support. The support has an outwardly facing surface whereon various sized article holding pockets can be secured. A strap like extension extends from the support and is attached to a vertical strap on the harness. Article holding pockets are secured to the outwardly facing surface on the support, and at least one water bottle carrying pocket is secured to the vertical strap on the harness. The water bottle is attached at a proper level and has a flexible tube extending out from its mouth enabling a person engaged in an activity requiring the use of both hands to move his head so the end of the tube can enter his mouth permitting the person to get a drink without using his hands.

Ducros, U.S. Pat. No. 5,400,934 describes a rucksack, or backpack, making it possible to drink, or inhale oxygen, while walking. The rucksack comprises of two straps wherein at least one of its two straps defines a protective, isothermic inner space, for example by means of a foldable protective band which is sewn on the upper half of the strip. A recipient is place in the rucksack and its tube passes in this protective space and finally terminates in a valve for drinking or inhaling.

Thatcher, U.S. Pat. No. 5,427,290 describes a sportsman's or athlete's water pouch backpack having a body portion connected to the person by a pair of padded shoulder straps and a quick-release, buckled hip belt. A removable bladder assembly is contained within the pack and has a bladder having a fill connection, a tube and mouthpiece valve, a handle and an internal baffle that maintains a proper bladder shape and prevents sloshing when the bladder is filled with liquid.

Paczonay, U.S. Pat. No. 5,601,207 describes a bite valve for delivering liquid to the mouth of an individual which includes a hollow body portion and a deformable closure connected to the body portion. A plurality of spaced slits are formed in the deformable closure. A portion of the deformable closure between the slits changes shape when the bite valve is subjected to opposed compressive forces. The causes the portion of the deformable closure to change shape and the slits to open and form a plurality of openings allowing liquid to flow through the deformable closure.

The prior art teaches a portable drinking apparatus, as well as various mechanisms to facilitate its use. However, the prior art does not teach an easily mounted and adjustable drinking tube and mouthpiece for use with a portable drinking apparatus that securely attaches to the user's chest and is easily adjustable to make water consumption while riding a bicycle both simple and effortless, and most importantly, possible without the use of one's hands. The present invention fulfills these needs and provides further related advantages as described in the following summary.

SUMMARY OF THE INVENTION

The present invention teaches certain benefits in construction and use which give rise to the objectives described below.

The present invention provides a portable drinking facilitation apparatus for use, by a bicyclist, of a liquid reservoir and a reservoir delivery tube. The apparatus has a flexible drinking tube having a mounting end and a terminal end. The drinking tube is adapted for being shaped, such that said ends are positioned as desired, and the drinking tube will hold the given shape until said ends are repositioned. In its preferred mode, the flexible drinking tube comprises a plurality of tube segments joined end-to-end to form an extended elongate tube. A bite valve is removably mounted at the terminal end of the drinking tube. The apparatus also has a base fitting for receiving the mounting end of the drinking tube. The base fitting is adapted for receiving an end of the reservoir delivery tube and the mounting end of the drinking tube. This arrangement allows water to flow from the reservoir delivery tube, through the base fitting, and into the drinking tube, from which it is dispensed to the user. This base fitting is attached to a flexible base plate having a chest strap mounting means to hold the base plate securely against the bicyclist's chest and place the bite valve within reach of the lips of the bicyclist.

A primary objective of the present invention is to provide a portable drinking facilitation apparatus to bicyclists, the apparatus having advantages not taught by the prior art.

Another objective is to provide an adjustable drinking tube and mouthpiece for use with a portable drinking apparatus that securely attaches to the user's chest and is easily adjustable to make water consumption while riding a bicycle both simple and effortless.

A further objective is to provide a drinking tube which is attached firmly and immovably, yet also is able to flex in order to accommodate the bicyclist's movements, i.e. accommodate his position or attitude relative to the bicycle.

A further objective is to provide a drinking tube which allows the bicyclist to interchange bite valves to accommodate multiple users without forcing them to share a common mouthpiece.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 5:
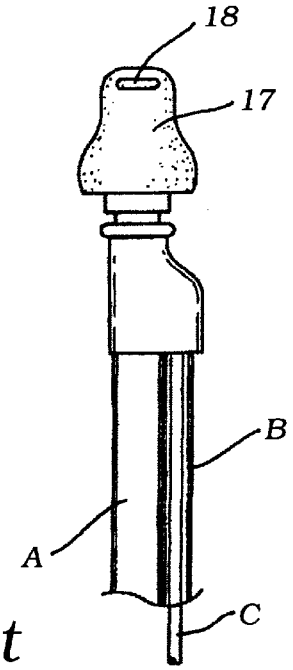
Fig. 5 Prior Art
FIG. 5 is an partial elevational view of a prior art water delivery system.

The prior art includes a means for providing adjustable contour to a drinking straw. In FIG. 5 is shown a double tube consisting of two co-extruded tubes (A) and (B) (side-by-side) made of a flexible material such as polyethylene. Inserted within one of the two tubes is a ductile metal rod (C) such a copper or annealed aluminum. One of the tubes (B) is therefore used to allow purposeful shaping to the tubes, while the other (A) is used as a straw.

Figure 2:
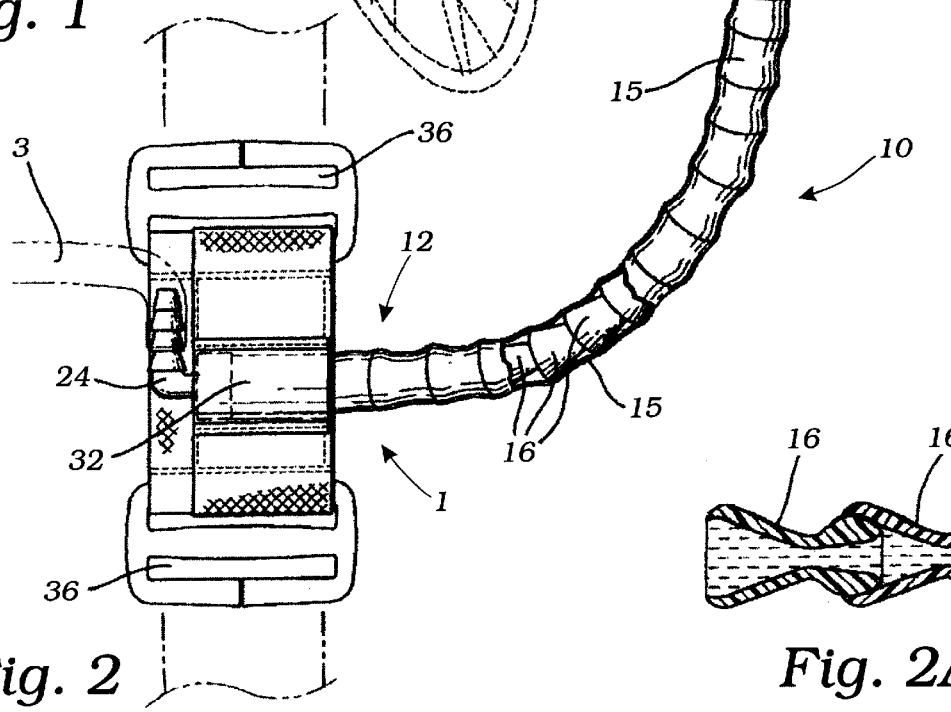
FIG. 2 is a front elevational view thereof.
Figure 2A:
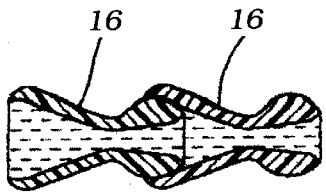
FIG. 2*a* is a sectional view of a portion of a segmented tube of the invention.

The above described drawing figures illustrate the invention, an improvement over the prior art, a portable drinking facilitation apparatus 1 for use by a bicyclist 4 or other persons where water or other liquid refreshment is necessary or desirable on a more or less continuous basis. The apparatus 1 is preferably used with a liquid reservoir 2 having a delivery tube 3. The example of a bicyclist is used throughout as an illustration of a preferred use, but the uses of the instant invention are broad and should not be thought of as being limited to any one single application. Such a reservoir and delivery tube is adequately described in the prior art, as for example in the Ducros reference. The apparatus 1 has a flexible drinking tube 10 having a mounting end 12 and a terminal end 14. The drinking tube 10 is adapted for shaping, such that said ends 12 and 14 are positioned as desired, and the drinking tube 10 will hold the given shape until said ends 12 and 14 are repositioned. In its preferred mode, the flexible drinking tube 10 comprises a plurality of tube segments 16 joined end-to-end to form an extended elongate tube. The tube segments 16 are preferably made of a hard plastic, preferably similar to the tube segments 16 commercially available as LOC-LINE™. As shown in FIG. 2A, each joined pair of the tube segments 16 are mutually swivelable so that the drinking tube 10 may be articulated into a desired conformation, as for example, straight, S-shaped, C-shaped, etc. Further, each joined pair of the tube segments 16 are tightly and stiffly joined so as to form a watertight drinking tube 10 which can hold a given conformation until purposely manipulated into a further desired conformation. The drinking tube 10 is preferably covered with a material sheath 15 such as an elastic cloth tube. The material sheath is not only decorative, it also keeps debris from getting onto the tube segments 16, and possibly contaminating the water being consumed by the bicyclist 4. It also helps the tube slide more easily over surface it may contact.

The drinking tube 10 preferably has a bite valve 17 removably mounted at the terminal end 14. The bite valve 17, such as the device described in U.S. Pat. No. 5,601,207, by Paczonay, herein incorporated by reference, allows the bicyclist 4 to trigger the flow of water by simply biting the bite valve 17. Similar bite valves 17 which are no longer covered by patents are well known in the art and can be used interchangeably with this invention. As shown in FIGS. 2 and 5, it is preferred that the bite valve 17 include a positioning ridge 18 to allow the bicyclist 4 to correctly position his teeth, so when he bites the bite valve 17 it triggers the flow of water by mouth suction. The bite valve 17 must be small enough to fit comfortably between the lips of a bicyclist 4, and is preferably made of a rubber-like substance which will not hurt the bicyclist's teeth when he or she bites the bite valve 17. The bite valve 17 is preferably attached to the drinking tube 10 at a female adapter 19A, so the bicyclist 4 can easily interchange the apparatus 1 with different bite valves 17, allowing several different bicyclists to use the apparatus 1 without having to share bite valves 17. The female adapter 19A accepts a male portion 19B of the bite valve 17. The male portion 19B is preferably a flexible and textured plastic or rubber-like substance which removably engages the female adapter 19A to allows water to be transmitted from the drinking tube 10 to the bite valve 17. Other interconnecting hardware may be used to make such connections as is well known in the art.

The apparatus 1 also has a base fitting 20 for receiving the mounting end 12 of the drinking tube 10 for supporting the drinking tube 10 in extension outwardly therefrom. The base fitting 20 is also adapted for receiving an end of the delivery tube 3 for conducting liquid from the liquid reservoir 2 to the drinking tube 10. The base fitting 20 is preferably a water transmitting chamber 22, preferably made of hard plastic, preferably having an integral reservoir input fitting 24 and an integral drinking tube adapting fitting 26. The reservoir input fitting 24 is preferably a hard plastic tube with an outer diameter of approximately 1 centimeter. The reservoir input fitting 24 preferably has a textured exterior so that the flexible rubber reservoir delivery tube 3 can be stretched over the exterior of the reservoir input fitting 24 to remain removably attached to the base fitting 20 and in fluid communication with the water transmitting chamber 22. The drinking tube adapting fitting 26 is preferably a plastic knob contoured like the various tube segments 16 of the drinking tube 10. The last tube segment 16 in the drinking tube 10 snaps onto the drinking tube adapting fitting 26 in the same manner that the various tube segments 16 of the drinking tube 10 fit together. This arrangement allows water to flow from the reservoir delivery tube 3, through the water transmitting chamber 22 and into the drinking tube 10, from which it is dispensed to the user.

Figure 1:
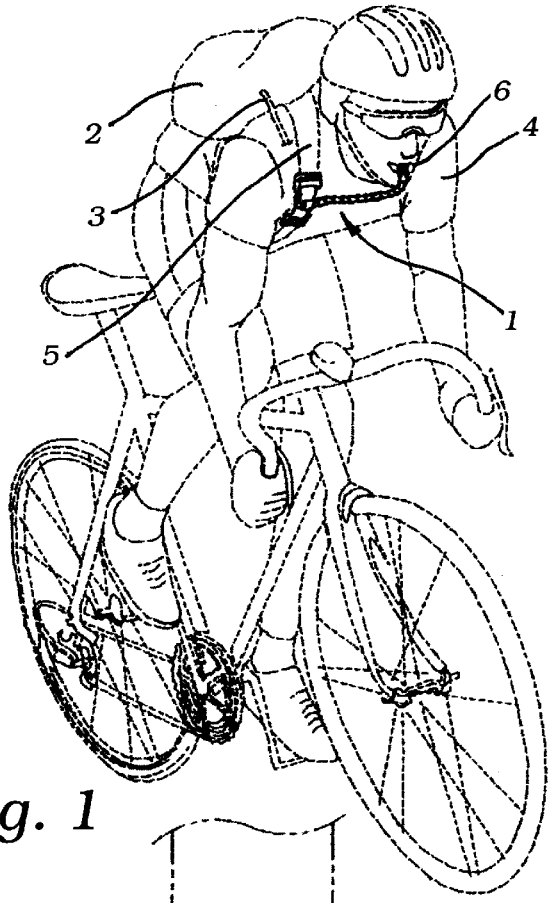
FIG. 1 is a perspective view of the preferred embodiment of the present invention shown in a preferred application for providing liquid to a bicycler.
Figure 3:
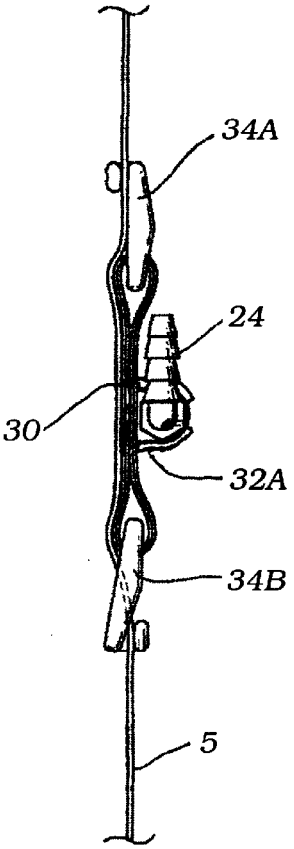
FIG. 3 is a left side elevational view thereof.
Figure 4:
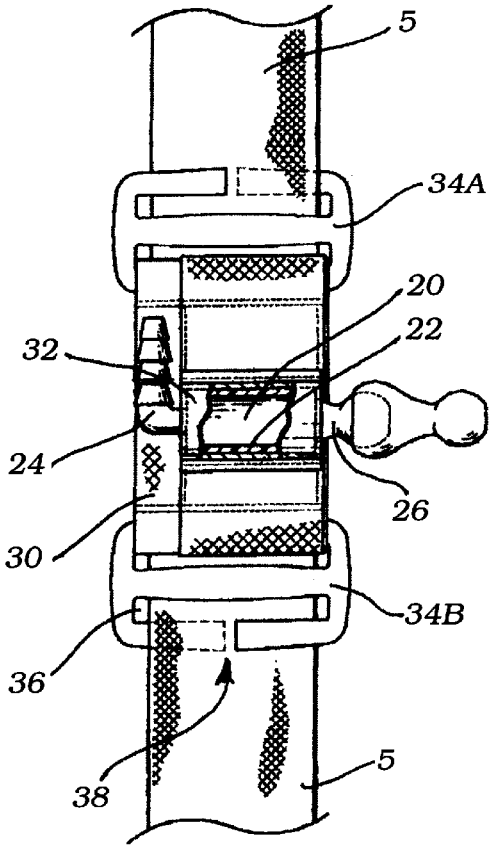
FIG. 4 is similar to FIG. 2 but showing a preferred manner of mounting the invention onto a mounting strap (shown partially inserted) and showing further details of a coupling fitting of the invention including a right-angle tube coupler for accepting a plastic tube thereon and a spherical joint fitting for accepting the segmented tube thereon in rotational engagement.

The apparatus 1 also has a flexible base plate 30 providing base fitting engagement means for restricting motion of the base fitting 20 thereon. Alternately, the base fitting may snap into a cradle formed integrally with the base plate 30 as shown in FIG. 3. A chest mounting means for removably mounting the base plate 30 onto a mounting strap 5 worn by a bicyclist 4 so as to place the terminal end 14 of the drinking tube 10 within reach of the lips 6 of the bicyclist 4 is best illustrated in FIG. 1. The base plate 30 is preferably at least one layer of flexible but inelastic material such as nylon or polyester but may just as easily be formed as a plastic molded part. It is preferred that the base plate 30 be flexible to flex with the movements of the bicyclist 4 and to adapt to the shape of the surface upon which it mounts, but inelastic to maintain a secure position on the bicyclist's mounting strap 5, typically one of the straps that supports the reservoir 2. The base fitting engagement means 32 is preferably a strap formed as a loop encircling the base fitting 20 as shown in FIGS. 2 and 4, or a snap-in cradle, preferably of molded plastic, as shown in FIG. 3 and shown as reference 32A. The strap 32 is preferably made of an inflexible material such as a hard plastic, to securely hold the base fitting 20 in place on the base plate 30. The strap 32 may be formed as a single loop as shown in FIG. 2, or may be formed as two parts as shown in FIG. 3 for snap action insertion and removal. The strap mounting means is preferably a pair of spaced apart buckles 34A and 34B, each of the buckles 34A and 34B providing a slot 36 for accepting the mounting strap 5 wherein the slot 36 is narrower than the thickness of the strap 5. The buckles 34A and 34B are preferably made of a hard plastic. Each of the buckles 34A and 34B preferably has a split portion 38 enabling insertion of the chest strap 5 into the buckles 34A and 34B laterally. The split portion 38 allows the bicyclist 4 to mount or remove the apparatus 1 without removing the chest strap 5. Alternately the mounting strap mounting means may include one or more clamping plates (not shown) positioned for sandwiching the mounting strap 5 between the clamping plates and the base plate. Such an assembly may be held together with wire or cable straps or a wide variety of other hardware as is well known in the art.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A portable drinking facilitation apparatus removably positionable on a mounting strap for conducting a liquid from a delivery tube to a mouth operated valve, the apparatus comprising:

a flexible drinking tube having a mounting end and a terminal end, the drinking tube providing a means for shaping so as to be adaptive for shaping, such that said ends are mutually positionable as necessary for conducting the liquid from the delivery tube to the mouth operated valve, the tube holding a given shape until said ends are purposely repositioned;

a base fitting for receiving one end of the flexible drinking tube for supporting the drinking tube in extension outwardly therefrom, and further, for receiving an end of the delivery tube for conducting the liquid to the drinking tube;

a base plate providing a means for supporting the base fitting, and further providing a strap mounting means for removably engaging the base plate onto the mounting strap for placing the mouth operated valve for drinking.

2. The apparatus of claim 1 wherein the shaping means comprises a plurality of tube segments joined end-to-end to form an extended elongate tube, each joined pair of the tube segments being mutually swivelable so that the drinking tube may be articulated into a desired conformation, and further, each joined pair of the tube segments being tightly and stiffly joined so as to conduct a liquid therethrough without leaking therebetween, and for holding a given conformation until purposely manipulated into a further desired conformation.

3. The apparatus of claim 1 wherein the base fitting supporting means is a strap forming a loop for encircling the base fitting for holding the base fitting against the base plate.

4. The apparatus of claim 1 wherein the base fitting engagement means is formed integrally with the base plate and with the base fitting.

5. The apparatus of claim 1 wherein the base fitting engagement means is configured for snapping the base fitting into the base fitting engagement means.

6. The apparatus of claim 1 wherein the strap mounting means is a pair of spaced apart strap engagement means, each of the strap engagement means providing a slot for accepting the mounting strap in such manner as to enable the apparatus to be removably engaged with the mounting strap and positionable therealong wherein the slot is narrower then the thickness of the strap.

7. The apparatus of claim 6 wherein each of the strap engagement means has a split portion enabling insertion of the apparatus onto the mounting strap laterally.

8. The apparatus of claim 1 wherein the base plate is made of a plurality of fabric layers.

9. The apparatus of claim 1 wherein the base plate is made of molded plastic.

* * * * *